US011725541B2

(12) United States Patent
Müller et al.

(10) Patent No.: US 11,725,541 B2
(45) Date of Patent: Aug. 15, 2023

(54) METHOD AND DEVICE FOR REMOVING AND/OR INSTALLING AN ANNULAR COMPONENT

(71) Applicant: Siemens Energy Global GmbH & Co. KG, Bayern (DE)

(72) Inventors: Dirk Müller, Mulheim a.d.Ruhr (DE); Christian Kowalzik, Berlin (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/270,020

(22) PCT Filed: Aug. 2, 2019

(86) PCT No.: PCT/EP2019/070894
§ 371 (c)(1),
(2) Date: Feb. 21, 2021

(87) PCT Pub. No.: WO2020/048699
PCT Pub. Date: Mar. 12, 2020

(65) Prior Publication Data

US 2021/0324764 A1 Oct. 21, 2021

(30) Foreign Application Priority Data

Sep. 4, 2018 (DE) ..... 10 2018 214 996.8

(51) Int. Cl.
*F01D 25/28* (2006.01)

(52) U.S. Cl.
CPC ..... *F01D 25/285* (2013.01); *F05D 2230/68* (2013.01); *F05D 2230/70* (2013.01)

(58) Field of Classification Search
CPC .... F01D 25/285; F01D 25/28; F05D 2230/70; F05D 2230/68; B64F 5/10; F23R 3/60
See application file for complete search history.

(56) References Cited

U.S. PATENT DOCUMENTS

| | | | | |
|---|---|---|---|---|
| 9,512,723 | B2 * | 12/2016 | Muller | F01D 25/285 |
| 2015/0026979 | A1 | 1/2015 | Muller | |
| 2016/0376927 | A1 * | 12/2016 | Mogle, II | B64D 27/26 29/283 |
| 2019/0211712 | A1 | 7/2019 | Müller et al. | |

FOREIGN PATENT DOCUMENTS

| | | | |
|---|---|---|---|
| DE | 10029679 | C1 | 1/2002 |
| DE | 102016217980 | A1 | 3/2018 |
| EP | 2610439 | A1 | 7/2013 |
| WO | 2013098028 | A1 | 7/2013 |

OTHER PUBLICATIONS

PCT International Search Report and Written Opinion of International Searching Authority dated Nov. 13, 2019 corresponding to PCT International Application No. PCT/EP2019/070894 filed Aug. 2, 2019 (previously submitted).
International search report and written opinion dated Nov. 13, 2019, for corresponding PCT/EP2019/070894.

* cited by examiner

*Primary Examiner* — Christopher J Besler
(74) *Attorney, Agent, or Firm* — Wolter Van Dyke Davis, PLLC

(57) ABSTRACT

A device for removing and/or installing an annular component, which is arranged at a position within a turbine housing, which position is accessible via an access point of the turbine housing. A method for removing and for installing a component of this type by a device of this type.

14 Claims, 6 Drawing Sheets

METHOD AND DEVICE FOR REMOVING AND/OR INSTALLING AN ANNULAR COMPONENT

CROSS REFERENCE TO RELATED APPLICATIONS

This application is the US National Stage of International Application No. PCT/EP2019/070894 filed 2 Aug. 2019, and claims the benefit thereof. The International Application claims the benefit of German Application No. DE 10 2018 214 996.8 filed 4 Sep. 2018. All of the applications are incorporated by reference herein in their entirety.

FIELD OF INVENTION

The present invention relates to a method and a device for removing and/or installing an annular component which is arranged within a turbine housing at a position which is accessible via an access point of the turbine housing.

BACKGROUND OF INVENTION

Annular components of the type mentioned at the outset which are of split configuration and which can be, for example, oil boxes or the like, are currently removed or installed manually, in particular within the context of maintenance and repair work. On account of the tightness within the turbine housing and the high weight of the component, however, this is very problematic. Firstly, the staff can be injured easily during the handling of the component. Secondly, the handling entails a high physical load. Moreover, the manual removing and/or installing takes a lot of time, which leads to undesirably long downtimes of the turbine and accordingly to high costs.

SUMMARY OF INVENTION

Proceeding from this prior art, it is an object of the present invention to provide an alternative method for removing and/or installing an annular component of this type, and suitable aids which can be used in the process.

In order to achieve this object, the present invention provides a device for removing and/or installing an annular component which is arranged within a turbine housing at a position which is accessible via an access point of the turbine housing, comprising at least two sliding rails which are designed to be introduced through the access point into the interior of the turbine housing and to be mounted in the lower turbine housing region such that they extend in a longitudinal direction and parallel to one another, and further comprising a slide which can be introduced through the access point into the interior of the turbine housing, can be placed onto the sliding rails, can be moved to and fro along the latter in the longitudinal direction, and has a base plate and a component receptacle device which, as viewed in the longitudinal direction, is fastened in a front end region of the base plate and is designed in such a way that the component to be removed or to be installed can be received on it and can be fastened to it releasably, the construction at least of the base plate being adapted to the construction of the component receptacle device in such a way that the weight of the component which is received on the component receptacle device is compensated for by way of the weight of the base plate as a counterweight, in such a way that wobbling of the slide on the sliding rails due to the additional weight of the component is prevented.

By way of a device of this type, an annular component which is to be removed or installed can be moved reliably with a low physical load within the turbine housing between the installation position of the component and the access point of the turbine housing, and can be removed and/or installed. The positioning of the component receptacle device in the front end region of the bottom plate of the slide is advantageous in so far as the component receptacle device can be moved without problems as far as the installation position of the component. Since a positioning of this type of the component receptacle device, in particular when a component is held on the latter, leads to a very unfavorable distribution of weight, which can produce wobbling of the slide on the sliding rails, the construction of the base plate and of the component receptacle device is adapted to one another in such a way that the weight of the component which is received on the component receptacle device is compensated for by way of the weight of the base plate as a counterweight. In this way, even when a component is received on the component receptacle device, a wobbling-free movement of the slide on the sliding rails is ensured.

In accordance with one refinement of the present invention, the base plate is of annular segment-shaped configuration. In other words, the shape of the base plate is adapted to the cylindrical shape of the turbine housing interior space which is defined by way of the turbine housing. This leads to it not being possible for the base plate to collide during its movement through the turbine housing interior space with other turbine components which are arranged there, such as, in particular, with the turbine rotor.

A predefined front region of the base plate can advantageously be moved in the longitudinal direction beyond the front end of the sliding rails, a first sliding face which is, in particular, circularly annular segment-shaped being provided in this predefined region on the underside of the base plate. This refinement takes account of a turbine housing construction, in the case of which, on account of a lack of space because of a radially inwardly projecting turbine housing shoulder, the sliding rails cannot be guided completely as far as the installation position of the annular component. In the region of a turbine housing shoulder of this type, the circularly annular segment-shaped sliding face of the base plate of the slide then lies on the turbine housing shoulder, and facilitates a movement of the slide as far as the installation position of the component.

The component receptacle device can advantageously be adjusted vertically relative to the sliding rails, in order to make a precision orientation of the component receptacle device in relation to the installation position of the component and/or in relation to the component itself possible. In accordance with one variant of the present invention, said vertical adjustability is achieved by the fact that the first sliding face is configured on a sliding face element which is received in a cutout of the base plate and can be moved up and down relative to the base plate via an actuating device.

A second sliding face which is, in particular, circularly annular segment-shaped is advantageously provided opposite the first sliding face in the upper region of the component receptacle device, the radius of which second sliding face corresponds to that of the first sliding face. In this way, the slide can be moved in a sliding manner along the turbine housing shoulder not only in a downward direction but also in an upward direction, which leads to very stable and smooth-running handling of the slide.

In accordance with one refinement of the present invention, the component receptacle device has an annular carrier element which extends upward starting from the base plate and on which a plurality of component receptacle flanges which project outward in the longitudinal direction are provided in a manner which is distributed circumferentially, which component receptacle flanges define radial outer faces which extend in the circumferential direction and are arranged on a common circular arc, the diameter of which is slightly smaller than the internal diameter of the component. The annular configuration of the carrier element leads to a very stable construction of the component receptacle device, it also being prevented here that the component receptacle device can collide with other turbine components during the movement of the slide along the sliding rails. Thus, during the movement of the slide along the sliding rails, the carrier element is pushed simply over the turbine rotor as far as the installation position of the component. When the component is reached, the component receptacle flanges are introduced into the internal diameter of the component, with the result that the inner circumferential face of the component bears against the radial outer faces. To this end, the center point of the circular arc, on which the radial outer faces are arranged, and the center point of the annular component have to be flush with one another in the longitudinal direction, which possibly requires a corresponding orientation of the component receptacle device, which orientation can take place, for example, via the abovementioned vertical adjustment.

An outwardly pointing end face of the carrier element or an outwardly pointing end face of a component receptacle flange advantageously defines a stop face for the component which is received on the component receptacle flanges, in order, during the receiving of the component on the component receptacle flanges, to achieve reproducible defined positioning of the component for the following fastening operation.

The carrier element and/or the component receptacle flanges are/is provided with through holes which extend in the longitudinal direction and through which fastening screws can be introduced which are screwed into threaded bores which are provided on the component.

In accordance with one refinement of the present invention, a handle is provided on the base plate and/or on the component receptacle device, in order to be able to grip the slide satisfactorily and to move it manually along the sliding rails.

In order to achieve the object mentioned at the outset, the present invention provides, furthermore, a method for removing an annular component which is arranged within a turbine housing at a position which is accessible via an access point of the turbine housing, with the use of a device according to the invention, comprising the following steps: a) introducing of the sliding rails through the access point of the turbine housing into the interior of the turbine housing; b) mounting of the sliding rails at predefined positions in the lower turbine housing region in such a way that they extend from a position in the region of the access point in a longitudinal direction and parallel to one another in the direction of the component to be removed; c) placing of the slide onto the sliding rails in such a way that the component receptacle device points in the direction of the component; d) moving of the slide on the sliding rails in the direction of the component until the component receptacle device receives the component, it being possible for the component receptacle device to optionally be oriented relative to the component beforehand; e) fastening of the component to the component receptacle device; f) moving of the slide on the sliding rails in the direction of the access point; g) detaching of the component from the component receptacle device; and h) removing of the component.

Thanks to a method of this type with use of the device according to the invention, simple, reliable removing of the component from the turbine housing, which removing causes little physical strain, can take place within a comparatively small time period.

Furthermore, the present invention provides a corresponding method for installing an annular component within a turbine housing at a predefined installation position which is accessible via an access point of the turbine housing, with the use of a device according to the invention, comprising the following steps: introducing of the sliding rails through the access point of the turbine housing into the interior of the turbine housing; mounting of the sliding rails at predefined positions in the lower turbine housing region in such a way that they extend from a position in the region of the access point in a longitudinal direction and parallel to one another in the direction of the predefined installation position; placing of the slide onto the sliding rails in such a way that the component receptacle device points in the direction of the predefined installation position; receiving and fastening of the component on/to the component receptacle device; moving of the slide on the sliding rails in the direction of the predefined installation position until the component is arranged at the predefined installation position, it being possible for the component receptacle device to optionally be oriented relative to the installation position beforehand; detaching of the component from the component receptacle device; and moving of the slide on the sliding rails as far as into the region of the access point.

BRIEF DESCRIPTION OF THE DRAWINGS

Further features and advantages of the present invention will become clear on the basis of the following description of one embodiment of a device according to the invention with reference to the drawing, in which.

DETAILED DESCRIPTION OF INVENTION

Figure 3:
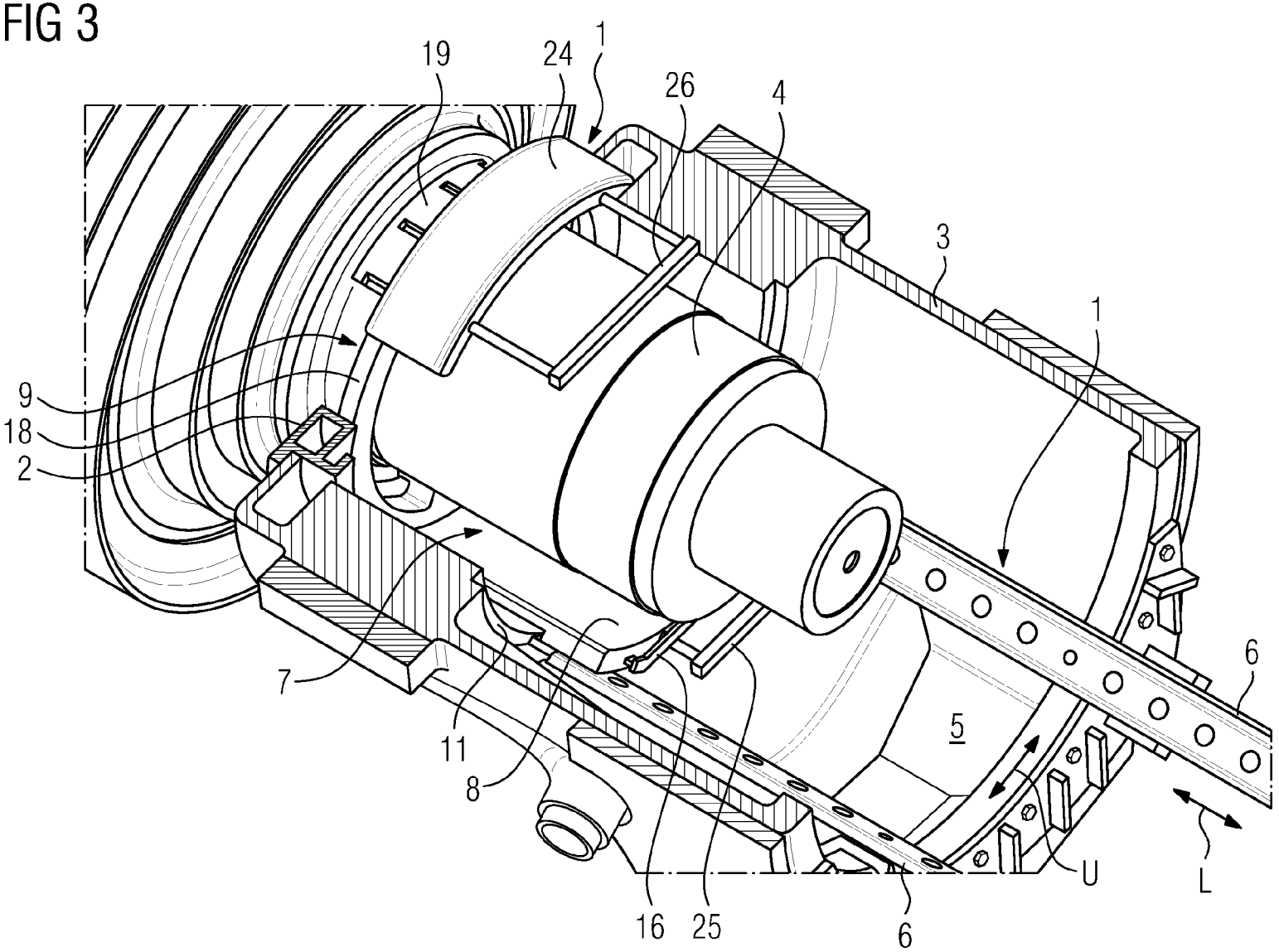
FIG. 3 shows a perspective, partially sectioned view of the device according to the invention in a state, in which it is installed in the interior of a turbine housing, the slide of the device being situated in the region of an installation position of an annular component to be removed.
Figure 4:
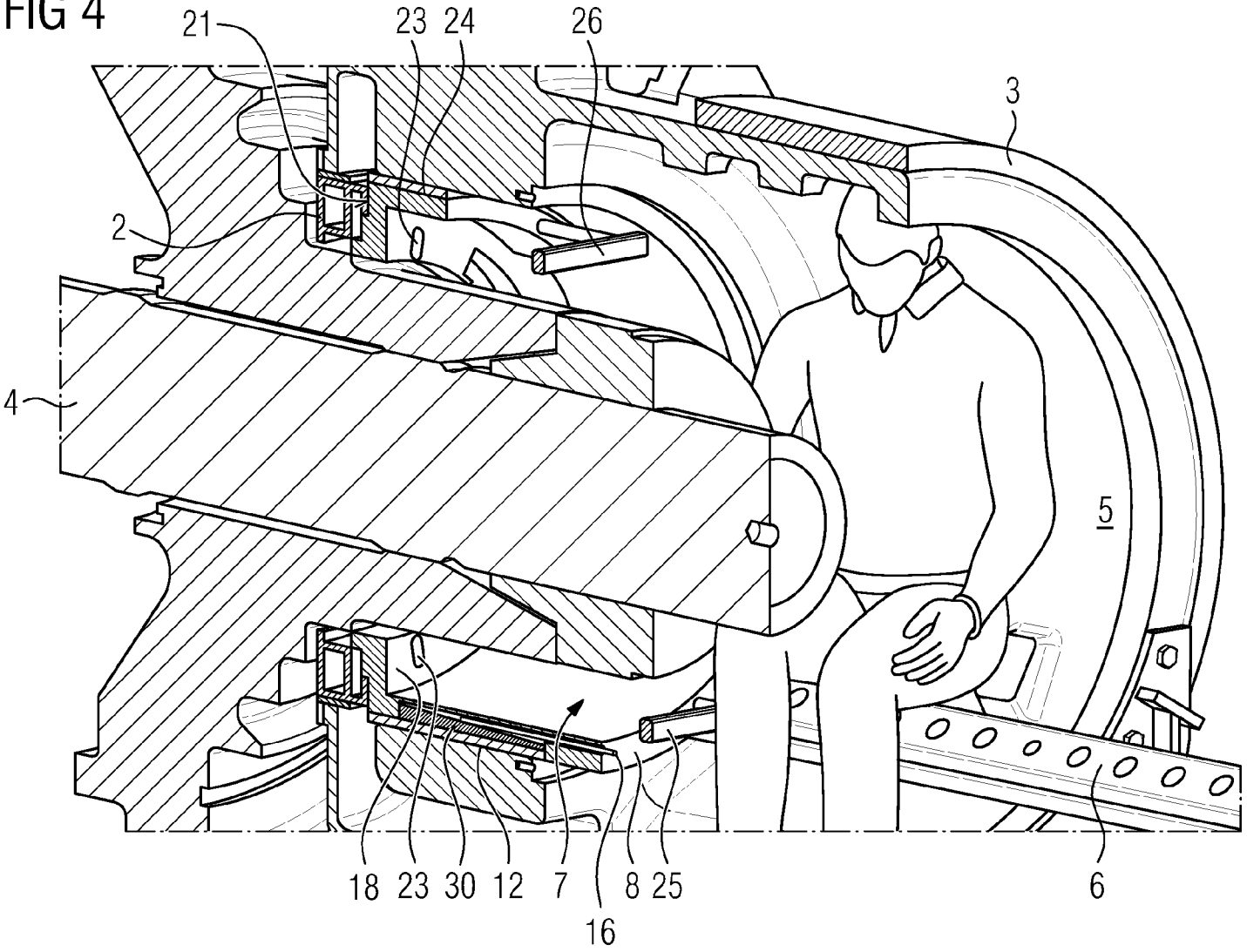
FIG. 4 shows a further perspective, partially sectioned view of the arrangement which is shown in FIG. 3.
Figure 5:
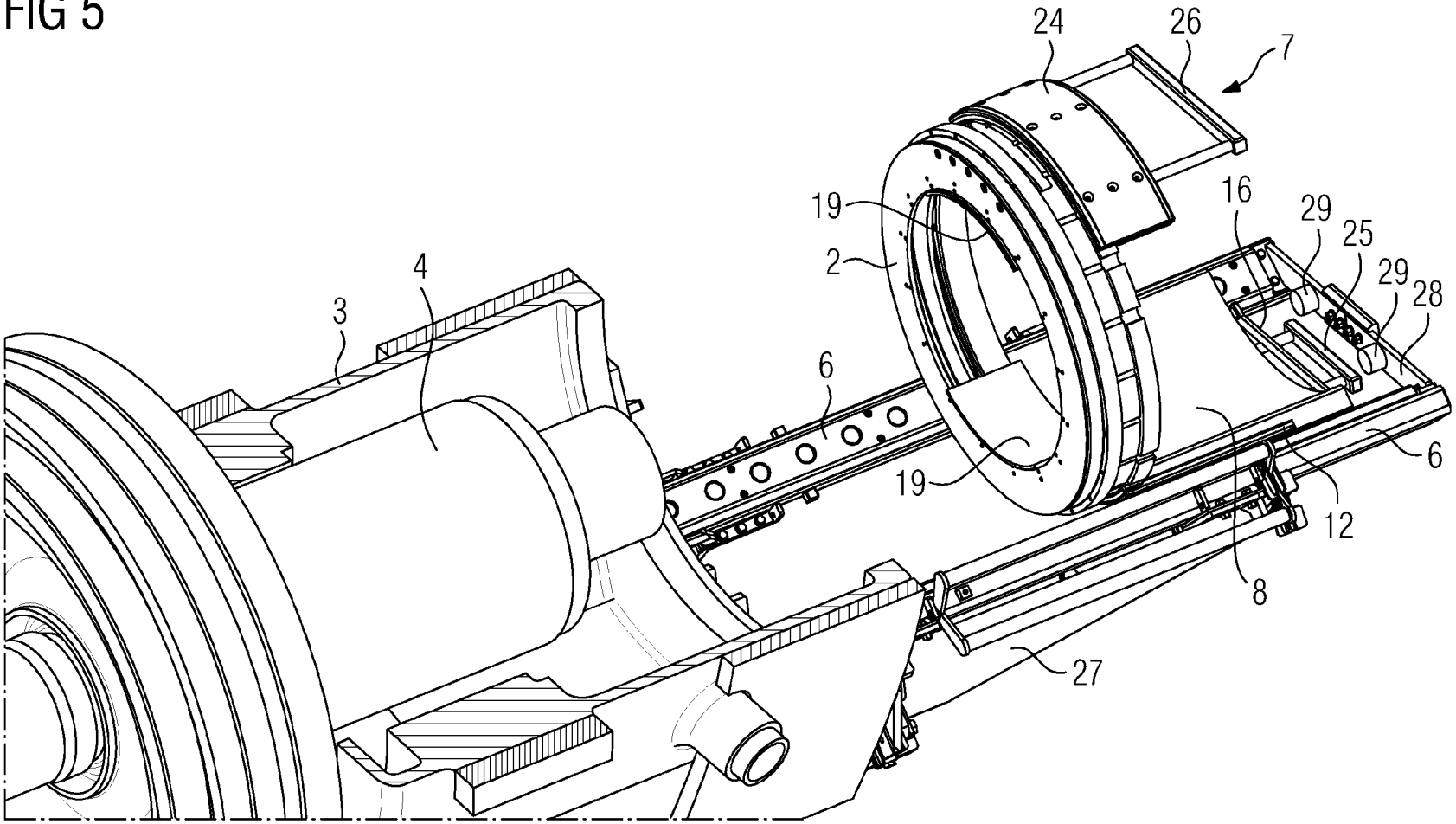
FIG. 5 shows a perspective, partially sectioned arrangement similar to FIGS. 3 and 4 in a state, in which the slide with a component which is held on it is situated at a position outside the turbine housing.

The device 1 serves for removing and/or for installing an annular component 2 which is arranged within a turbine housing 3 at a position which is accessible via an access point 5 of the turbine housing 3. In the present case, the annular component 2 is what is known as an oil box with a sealing ring which is received in an annular housing and seals an annular gap between the turbine housing 3 and a turbine rotor 4, as shown in FIGS. 3 to 5. It is to be noted, however, that the component 2 can also be other annular components which are installed within the turbine housing. As main components, the device 1 comprises two sliding rails 6 and a slide 7 which can be moved on the latter.

The sliding rails 6 are configured to be introduced through the access point 5 into the interior of the turbine housing 3 and to be mounted in the lower turbine housing region such that they extend in a longitudinal direction L and parallel to one another. The slide 7 is also configured in such a way that it can be introduced through the access point 5 into the interior of the turbine housing 3 and can be placed onto the sliding rails 6 in such a way that it can be moved to and fro along said sliding rails 6 in the longitudinal direction L. The slide 7 comprises a base plate 8 and a component receptacle device 9 which is fastened in a front end region of the base plate 8 as viewed in the longitudinal direction L. In the present case, the base plate 8 is of annular segment-shaped configuration and is therefore adapted to the cylindrical shape of the turbine housing cavity. In the rear end region, the underside of the base plate 8 is provided with stops 10 which bear against the sliding rails 6 and limit the movement of the slide in the circumferential direction. Starting from the stops 10, a sliding face 12 which is likewise circularly annular segment-shaped in the present case is provided on the underside of the base plate 8, which sliding face 12 is configured on a sliding face element 13 which is received in a cutout of the base plate 8. In the case of the embodiment which is shown, the sliding face element 13 can be moved up and down in the direction of the arrow 15 relative to the base plate 8 via an actuating device 14 (not shown in detail), and can therefore be adjusted vertically. The vertical adjustment is brought about by a user by way of actuation of an adjusting unit 16 which is provided in the rear region of the base plate 8, by said adjusting unit 16 being pushed to and fro in the direction of the arrow 17. The movement of the adjusting unit 16 is transmitted to a wedge element 30 which is installed between the base plate 8 and the sliding face element 13 and moves the base plate 8 and the sliding face element 13 toward one another or away from one another. The component receptacle device 9 is fastened in a front end region of the base plate 8 as viewed in the longitudinal direction L. It is designed in such a way that the annular component 2 to be removed or to be installed can be received on it in a way which is flush with the annular gap in the longitudinal direction L, and can be fastened to it releasably. In the present case, the component receptacle device 9 has a carrier element 18 of annular configuration which extends upward starting from the base plate 8. Two component receptacle flanges 19 which project outward in the longitudinal direction L are provided on the carrier element 18 at the top and at the bottom so as to lie circumferentially opposite one another, which component receptacle flanges 19 define radial outer faces 20 which extend in the circumferential direction and are arranged on a common circular arc, the diameter of which is slightly smaller than the internal diameter of the component 2. Instead of two component receptacle flanges 19, it is of course fundamentally possible for more component receptacle flanges 19 to also be arranged such that they are distributed circumferentially on the carrier element 18. The component receptacle flanges 19 are positioned in the region of the inner circumference of the carrier element 18 in such a way that the outwardly pointing end face 21 of the carrier element 18 and/or the end faces 22 of the component receptacle flanges 19 define a stop face for the component 2 which is received on the component receptacle flanges 19. Through holes 23 extend in the longitudinal direction L through the end faces 22 of the component receptacle flanges 19, which through holes 23 serve for receiving fastening screws. The through holes 23 are widened behind the end faces 22, with the result that the fastening screws can be introduced without problems by way of a corresponding tool, such as, for example, by way of a screw driver or the like. A second sliding face 24 which is likewise circularly annular segment-shaped in the present case is provided opposite the first sliding face 12 in the upper region of the component receptacle device 9, the radius of which sliding face 24 corresponds to that of the first sliding face 12. A handle 25 and 26 is provided in each case on the base plate 8 and on the component receptacle device 9, in order to move the slide 7 manually on the sliding rails 6 in the longitudinal direction L.

Figure 1:
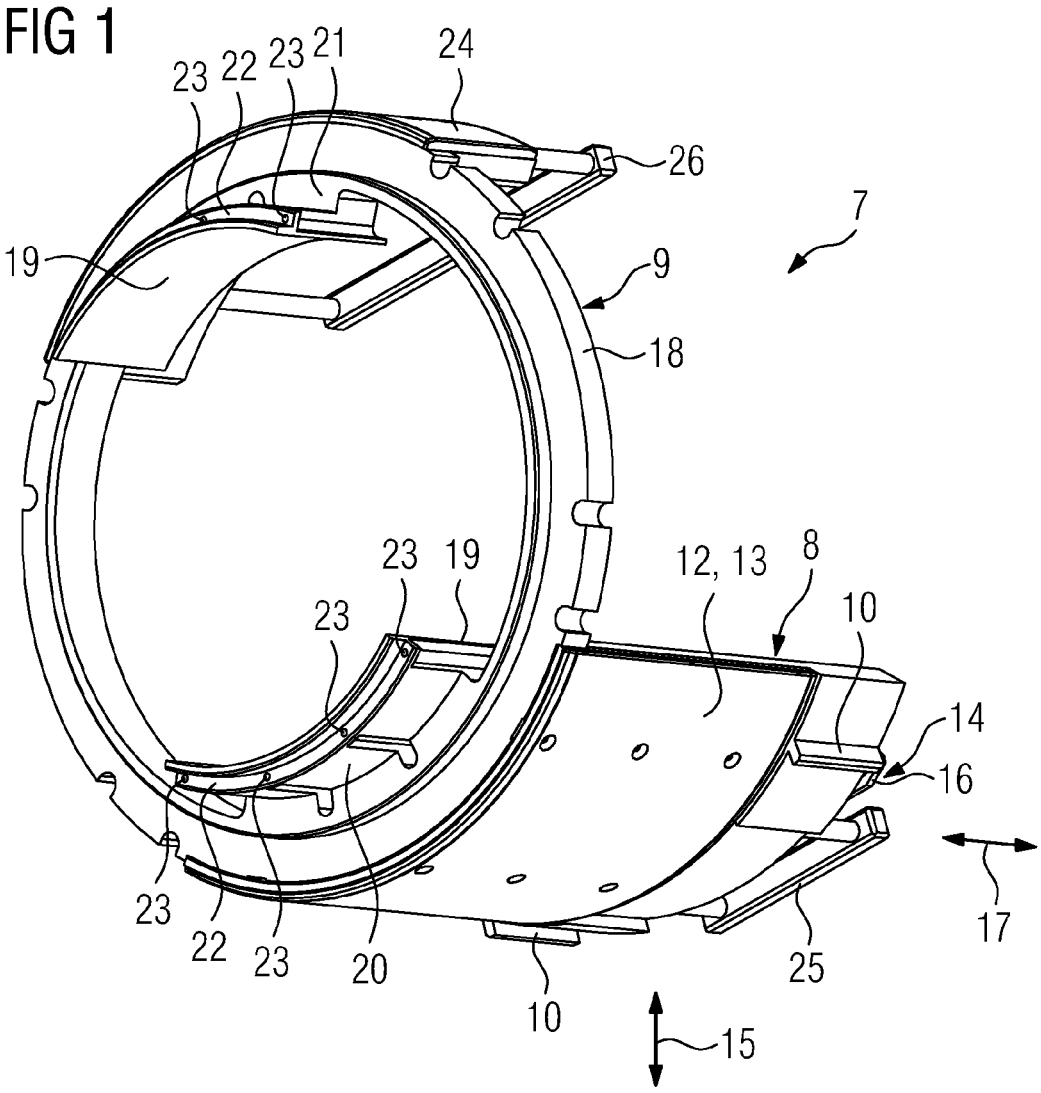
FIG. 1 shows a perspective view of a slide of a device in accordance with one embodiment of the present invention.
Figure 2:
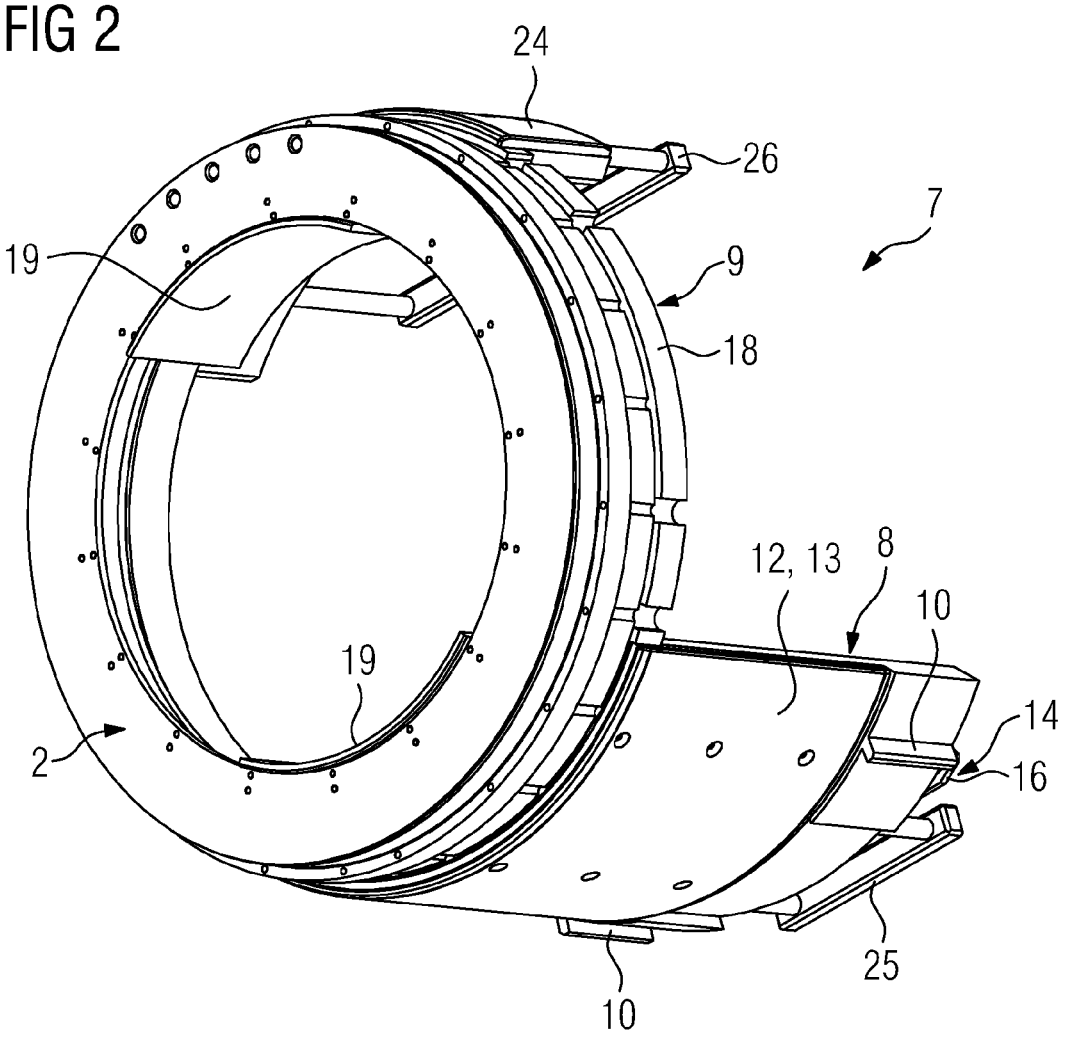
FIG. 2 shows a perspective view of the slide which is shown in FIG. 1 and on/to the component receptacle device of which an annular component is received and fastened.

FIG. 2 shows the slide 7 in a state, in which the component 2 is held on it and is fastened to it. In this state, the component receptacle flanges 19 engage into the inner circumference of the component 2 in such a way that the inner circumferential face of the component 2 is received on or bears against the outer faces 20 of the component receptacle flanges 19. Furthermore, that end face of the component 2 which points toward the component receptacle device 9 bears against the end face 21 of the carrier element 18. Fastening screws (not shown in greater detail) are guided through the through holes 23, which fastening screws are screwed into associated threaded bores (likewise not shown in greater detail in the present case) which are configured in the end face of the component 2. Accordingly, the component 2 is fastened securely to the slide 7. In order to hold the slide 7 which is placed onto the sliding rails 6 in equilibrium in this state, the construction of the base plate 8 including the sliding face element 13 is adapted to the construction of the component receptacle device 9 and to the weight of the component 2 in such a way that the additional weight of the component 2 which is received on the component receptacle device 9 is compensated for by way of the weight of the base plate 8 and the sliding face element 13 as a counterweight. As an alternative or in addition, however, the base plate 8 can also be provided with additional counterweights in the rear end region. Overall, it is prevented in this way that the slide 7 wobbles on the sliding rails 6 when a component 2 is received on it.

Figure 6:
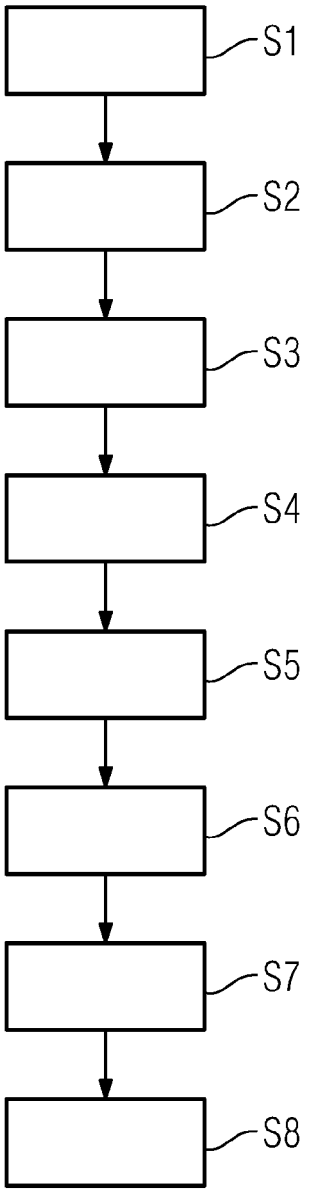
FIG. 6 shows a flow chart which diagrammatically shows the steps of removing of an annular component.

In the following text, a method for removing an annular component 2 will be described with reference to FIG. 6 and to FIGS. 3 to 5.

In a first step S1, the sliding rails 6 of the device 1 are introduced through the access point 5 of the turbine housing 3 into the interior of the turbine housing 3. The access point 5 has been provided in the present case by a turbine housing cover (not shown) having been removed.

The access point 5 can fundamentally also be, however, a manhole which is provided in the upper region of the turbine housing 3.

In a second step S2, the sliding rails 6 are mounted at predefined positions in the lower turbine housing region in such a way that they extend from a position in the region of the access point 5 in the longitudinal direction L and parallel to one another in the direction of the component 2 to be removed. In the present case, the sliding rails 6 project out of the turbine housing 3 and are supported by way of a supporting construction 27 on the turbine housing 3. Those free ends of the sliding rails 6 which project from the turbine housing 3 are connected to one another via a connecting strut 28, by way of which the required stability is achieved. Stop elements 29 are provided on the connecting strut 8, which stop elements 29 point in the direction of the turbine housing 3 and limit the movement of the slide 7 on the sliding rails 6 on the end side.

In a further step S3, the slide is placed onto the sliding rails 6 with use of a crane in such a way that the component receptacle device 9 points in the direction of the component 2.

In the step S4, the slide 7 is then moved on the sliding rails 6 in the direction of the component 2. As soon as the component receptacle device 9 of the slide 7 reaches the turbine housing shoulder 11, the sliding faces 12 and 24 of the slide 7 come into contact with the turbine housing wall in the region of the turbine housing shoulder 11, with the result that the sliding faces 12 and 24 slide on the turbine housing wall. Here, that region of the base plate 8, on which the sliding face 12 is arranged, is moved in the longitudinal direction L beyond the front end of the sliding rails 6. Within the context of this movement, the component receptacle flanges 19 of the component receptacle device 9 are pushed into the internal diameter of the component 2, with the result that the component 2 is received on the component receptacle device 9. Should the component receptacle device 9 and the component 2 not be oriented with respect to one another in an optimum manner, an orientation of the component receptacle device 9 relative to the component 2 can take place beforehand in an intermediate step, by the adjusting unit 16 moving in the direction of the arrow 17 and therefore the sliding face element 13 being moved relative to the base plate 8. In this way, a relative movement also takes place between the component receptacle device 9 and the sliding rails 6 in the upward or in the downward direction, as a result of which a vertical adjustment of the component receptacle device 9 takes place.

Subsequently, in step S5, the component 2 is fastened to the component receptacle device 9, by fastening screws being inserted through the through holes 23 of the component receptacle device 9 and being screwed to the component, as has already been described above.

In a further step S6, the slide 7 is moved on the sliding rails 6 in the direction of the access point 5 until the component is positioned in the region of the access point 5, in the present case outside the turbine housing 3, as shown in FIG. 5.

In the following step S7, the component 2 is detached from the component receptacle device 9, and can then be lifted from the slide 7 by way of a crane in a last step S8.

Figure 7:
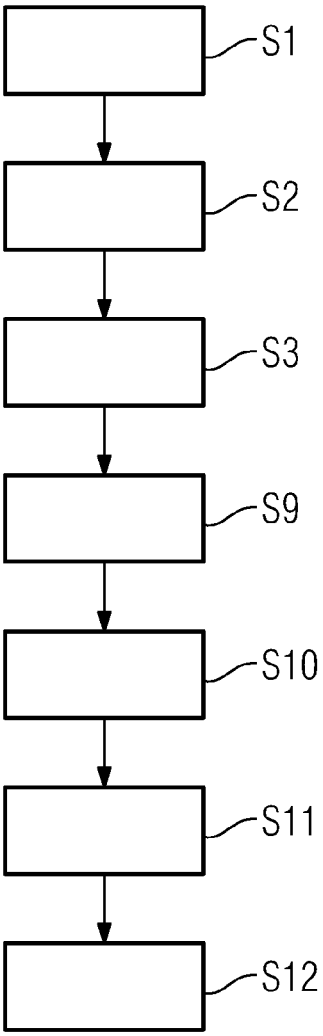
FIG. 7 shows a flow chart which diagrammatically shows the steps of installing of an annular component.

In order to install a new component 2, according to FIG. 7 in steps S1 to S3, the sliding rails 6 and the slide 7 are introduced through the access point 5 into the turbine housing 3, and are installed in the above-described way in the interior of the turbine housing 3, should this not yet have taken place beforehand.

In a step S9, the component 2 is received on the component receptacle device 9 and is fastened to it.

Subsequently, in step S10, the slide 7 is moved on the sliding rails 6 in the direction of the predefined installation position of the component 2 until the component 2 is arranged at the predefined installation position. Here too, an optional orientation of the component receptacle device 9 relative to the annular gap can take place beforehand if this should be necessary.

The component 2 on the component receptacle device 9 is then detached in step S11, whereupon the slide is moved back again on the sliding rails 6 in the direction of the access point 5 in the step S12.

A substantial advantage which is associated with the use of the above-described device 1 during the removing and/or installing of the component 2 consists in that the component 2 can be moved reliably and without great effort in the longitudinal direction L in the interior of the turbine housing 3. This is firstly beneficial to the safety and health of the staff. Secondly, however, a smaller time duration is also required for the removing and/or installing of the component 2, as a result of which downtimes of the turbine can be shortened and costs can be saved.

It is to be noted at this point that the construction of the device 1 is to be adapted fundamentally to the external conditions which are stipulated by way of the construction of the turbine.

Although the invention has been illustrated and described in greater detail by way of the exemplary embodiments, the invention is not restricted by way of the disclosed examples, and other variations can be derived herefrom by a person skilled in the art, without departing from the scope of protection of the invention.

The invention claimed is:

1. A device for removing and/or installing an annular component which is arranged within a turbine housing at a position which is accessible via an access point of the turbine housing, comprising:

two sliding rails configured to extend through the access point into an interior of the turbine housing when mounted to a lower turbine housing region of the turbine housing such that they extend in a longitudinal direction and parallel to one another, a slide configured to be placed onto the sliding rails and to be slid to and fro on the sliding rails in the longitudinal direction, wherein the slide comprises a base plate and a component mount which, as viewed in the longitudinal direction, is fastened in a front end region of the base plate and is designed in such a way that the component to be removed or to be installed can be received on it and can be fastened to it releasably, the base plate being adapted to the component mount in such a way that a weight of the component which is received on the component mount is compensated for by way of a weight of the base plate as a counterweight, in such a way that wobbling of the slide on the sliding rails due to the weight of the component is prevented, wherein the slide is configured such that movement to and fro on the sliding rails is effective to move the component mount and the base plate into and out of the interior of the turbine housing, wherein the front end region of the base plate can be moved in the longitudinal direction beyond a front end of the sliding rails, and a first sliding face is provided in a predefined region of the front end region on an underside of the base plate, and wherein the first sliding face is disposed on a radially outer face of a sliding face element which is received in a cutout of the base plate, wherein a radially inner face of the sliding face element comprises a ramped surface that is ramped in the longitudinal direction, and wherein the sliding face element is moveable up and down relative to the base plate by moving in the longitudinal direction an adjusting unit that is disposed between the ramped surface and the base plate along the ramped surface.

2. The device as claimed in claim 1, wherein the base plate comprises a shape that is a segment of a cylindrical shape, wherein the cylindrical shape is concentric with a base plate longitudinal axis, and wherein the base plate longitudinal axis is parallel to the sliding rails.

3. The device as claimed in claim 1, wherein a second sliding face is provided opposite the first sliding face in an upper region of the component mount, a radius of which second sliding face corresponds to that of the first sliding face.

4. The device as claimed in claim 1, wherein the component mount comprises an annular carrier element which extends upward starting from the base plate and on which a plurality of component receptacle flanges which project outward in the longitudinal direction are provided in a manner which is distributed circumferentially, which the plurality of component receptacle flanges define radial outer faces which extend in the circumferential direction and are arranged on a common circular arc, a diameter of the common circular arc is slightly smaller than an internal diameter of the component.

5. The device as claimed in claim 4, wherein an outwardly pointing end face of the carrier element or an outwardly pointing end face of a component receptacle flange of the plurality of component receptacle flanges defines a stop face for the component which is received on the plurality of component receptacle flanges.

6. The device as claimed in claim 5, wherein the carrier element and/or the component receptacle flanges are/is provided with through holes which extend in the longitudinal direction.

7. The device as claimed in claim 1, wherein a handle is provided on the base plate and/or on the component mount, in order to move the slide manually on the sliding rails in the longitudinal direction.

8. A method for removing an annular component which is arranged within a turbine housing at a position which is accessible via an access point of the turbine housing, with the use of a device as claimed in claim 1, the method comprising:

introducing the sliding rails of the device through the access point of the turbine housing into an interior of the turbine housing;

mounting the sliding rails at predefined positions in a lower region of the turbine housing in such a way that they extend from a position in a region of the access point in a longitudinal direction and parallel to one another in a direction of the component to be removed;

placing the slide of the device onto the sliding rails in such a way that the component mount points in the direction of the component;

moving the slide on the sliding rails in the direction of the component until the component mount receives the component, it being possible for the component mount to optionally be oriented relative to the component beforehand;

fastening the component to the component mount;

moving the slide on the sliding rails in a direction of the access point;

detaching the component from the component mount; and removing the component.

9. A method for installing an annular component within a turbine housing at a predefined installation position which is accessible via an access point of the turbine housing, with the use of a device as claimed in claim 1, the method comprising:

introducing the sliding rails of the device through the access point of the turbine housing into an interior of the turbine housing;

mounting the sliding rails at predefined positions in a lower region of the turbine housing in such a way that they extend from a position in a region of the access point in a longitudinal direction and parallel to one another in a direction of the predefined installation position;

placing the slide of the device onto the sliding rails in such a way that the component mount points in the direction of the predefined installation position;

receiving and fastening the component on/to the component mount;

moving the slide on the sliding rails in the direction of the predefined installation position until the component is arranged at the predefined installation position, it being possible for the component mount to optionally be oriented relative to the installation position beforehand; and detaching the component from the component mount and moving the slide on the sliding rails as far as into the region of the access point.

10. A device for removing and/or installing an annular component which is arranged within a turbine housing at a position which is accessible via an access point of the turbine housing, comprising:

two sliding rails configured to extend through the access point into an interior of the turbine housing when directly mounted to a lower turbine housing region of the turbine housing such that they extend in a longitudinal direction and parallel to one another, and a slide configured to be placed onto the sliding rails and to be slid to and fro on the sliding rails in the longitudinal direction, wherein the slide comprises a base plate and a component mount which, as viewed in the longitudinal direction, is fastened in a front end region of the base plate and is designed in such a way that the component to be removed or to be installed can be received on it and can be fastened to it releasably, the base plate being adapted to the component mount in such a way that a weight of the component which is received on the component mount is compensated for by way of a weight of the base plate as a counterweight, in such a way that wobbling of the slide on the sliding rails due to the weight of the component is prevented, wherein the slide is configured such that movement to and fro on the sliding rails is effective to move the component mount and the base plate into and out of the interior of the turbine housing, wherein the front end region of the base plate can be moved in the longitudinal direction beyond a front end of the sliding rails, and a first sliding face is provided in a predefined region of the front end region on an underside of the base plate, and wherein the first sliding face is disposed on a radially outer face of a sliding face element which is received in a cutout of the base plate, wherein a radially inner face of the sliding face element comprises a ramped surface that is ramped in the longitudinal direction, and wherein the sliding face element is moveable up and down relative to the base plate by moving in the longitudinal direction an adjusting unit that is disposed between the ramped surface and the base plate along the ramped surface.

11. The device of claim 10, wherein the adjusting unit comprises an elongated member.

12. The device of claim 1, wherein the underside of the base plate rests on the sliding rails and comprises a sliding face, and wherein the base plate can be moved in the longitudinal direction to extend the sliding face beyond the front end of the sliding rails.

13. The device of claim 12, wherein the base plate is configured to position the sliding face on the sliding rails so that the sliding face slides on the sliding rails when the slide is moved to and fro on the sliding rails.

14. The device of claim 12, wherein the sliding face comprises a convex shape that is a segment of a cylindrical shape, wherein the cylindrical shape is concentric with a sliding face longitudinal axis, wherein the sliding face longitudinal axis is parallel to the sliding rails, and wherein the sliding face faces the sliding rails.

* * * * *